US011100911B1

(12) United States Patent
Jain

(10) Patent No.: US 11,100,911 B1
(45) Date of Patent: Aug. 24, 2021

(54) SYSTEMS AND METHODS FOR ADAPTING ESTIMATED SECONDARY PATH

(71) Applicant: Bose Corporation, Framingham, MA (US)

(72) Inventor: Ankita D. Jain, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/025,382

(22) Filed: Sep. 18, 2020

(51) Int. Cl.
*G10K 11/178* (2006.01)

(52) U.S. Cl.
CPC .. *G10K 11/17854* (2018.01); *G10K 11/17881* (2018.01); *G10K 2210/1281* (2013.01); *G10K 2210/3026* (2013.01); *G10K 2210/3027* (2013.01); *G10K 2210/3028* (2013.01); *G10K 2210/3044* (2013.01)

(58) Field of Classification Search
CPC ..... G10K 11/17879; G10K 11/17854; G10K 11/17881; G10K 11/17883; G10K 2210/1281; G10K 2210/1282; G10K 2210/3026; G10K 2210/3027; G10K 2210/3028; G10K 2210/3044; G10K 2210/3055; G10K 2210/505
See application file for complete search history.

(56) References Cited

U.S. PATENT DOCUMENTS

2005/0207585 A1* 9/2005 Christoph ..... G10K 11/17883 381/71.11

* cited by examiner

*Primary Examiner* — Kile O Blair
(74) *Attorney, Agent, or Firm* — Bond, Schoeneck & King, PLLC

(57) ABSTRACT

A noise-cancellation system with secondary path adaptation, includes: a noise-cancellation filter configured to receive a reference signal representative of a source of noise within a predefined volume and generating, based at least in part on the reference signal, a noise-cancellation signal that, when transduced by a speaker, produces a noise-cancellation acoustic signal that reduces noise in a cancellation zone within the predefined volume; a secondary path estimation filter configured to receive an input signal and to implement an estimate of secondary path transfer function, the secondary path transfer function being a transfer function between the speaker and a cancellation zone, the secondary path estimation filter outputting an output signal based, at least in part, on the estimate of the secondary path transfer function and the input signal; an adaptive module configured to adjust coefficients of the noise-cancellation filter according to a first adaptive algorithm, based, at least in part, on the estimated output signal; and an secondary path adaptive module configured to adjust coefficients of the secondary path estimation filter according to a second adaptive algorithm, wherein a rate of adaptation of the second adaptive algorithm is based, at least in part, on a coherence between the reference signal and an error signal representative of residual noise within the cancellation zone.

20 Claims, 7 Drawing Sheets

SYSTEMS AND METHODS FOR ADAPTING ESTIMATED SECONDARY PATH

BACKGROUND

The present disclosure generally relates to systems and methods for adapting an estimate of a secondary path transfer function in an adaptive system.

SUMMARY

All examples and features mentioned below can be combined in any technically possible way.

According to an aspect, a noise-cancellation system with secondary path adaptation includes: a noise-cancellation filter configured to receive a reference signal representative of a source of noise within a predefined volume and generating, based at least in part on the reference signal, a noise-cancellation signal that, when transduced by a speaker, produces a noise-cancellation acoustic signal that reduces noise in a cancellation zone within the predefined volume; a secondary path estimation filter configured to receive an input signal and to implement an estimate of secondary path transfer function, the secondary path transfer function being a transfer function between the speaker and a cancellation zone, the secondary path estimation filter outputting an output signal based, at least in part, on the estimate of the secondary path transfer function and the input signal; an adaptive module configured to adjust coefficients of the noise-cancellation filter according to a first adaptive algorithm, based, at least in part, on the estimated output signal; and an secondary path adaptive module configured to adjust coefficients of the secondary path estimation filter according to a second adaptive algorithm, wherein a rate of adaptation of the second adaptive algorithm is based, at least in part, on a coherence between the reference signal and an error signal representative of residual noise within the cancellation zone.

In an example, wherein the input signal is the error signal, wherein the output signal is an estimated error that is phase-shifted with respect to the error signal to remove a delay between the speaker and the cancellation zone, wherein the delay is determined according to the estimate of the secondary path transfer function.

In an example, the input signal is the reference signal, wherein the output signal is an estimated reference signal that is phase-shifted with respect to the error signal to introduce a delay between the speaker and the cancellation zone, the delay being estimated according to the estimate of the secondary path transfer function.

In an example, the rate of adaptation is monotonically related to the coherence between the reference signal and the error signal.

In an example, the coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

In an example, the error signal comprises the output of a projection filter receiving an input from an error sensor disposed at a position outside the cancellation zone and configured to estimate the residual noise within the cancellation zone.

In an example, the first adaptive algorithm and the second adaptive algorithm are each least mean squares algorithms.

In an example, the error signal comprises the output of an echo canceler receiving an input from an error sensor and cancelling a component of the input attributable to the output of the speaker or at least a second speaker in the predefined volume.

In an example, the noise-cancellation system further includes an echo canceler receiving a program content signal, the program content signal being transduced by the speaker into a program content acoustic signal, the echo canceler comprising an echo canceler filter implementing the estimate of the secondary path transfer function such that the echo canceler filter outputs an estimated program content signal that estimates the program content signal acoustic signal at the cancellation zone, the estimated program content signal being subtracted from an input received from an error sensor to cancel a component of the input attributable to the program content acoustic signal.

According to another aspect, a non-transitory storage medium includes program code that, when executed by a processor, implements the steps of: receiving a reference signal representative of a source of noise within a predefined volume and generating with a noise-cancellation filter, based at least in part on the reference signal, a noise-cancellation signal that, when transduced by a speaker, produces a noise-cancellation acoustic signal that reduces noise in a cancellation zone within the predefined volume; outputting, with a secondary path estimation filter, an estimated output according to an estimate of a secondary path transfer function, the secondary path transfer function being a transfer function between the speaker and a cancellation zone, and an input signal; adjusting coefficients of the noise-cancellation filter according to a first adaptive algorithm, based, at least in part, on the estimated output signal; and adjusting coefficients of the secondary path estimation filter according to a second adaptive algorithm, wherein a rate of adaptation of the second adaptive algorithm is based, at least in part, on a coherence between the reference signal and an error signal representative of residual noise within the cancellation zone.

In an example, wherein the input signal is the error signal, wherein the output signal is an estimated error that is phase-shifted with respect to the error signal to remove a delay between the speaker and the cancellation zone, wherein the delay is determined according to the estimate of the secondary path transfer function.

In an example, the input signal is the reference signal, wherein the output signal is an estimated reference signal that is phase-shifted with respect to the error signal to introduce a delay between the speaker and the cancellation zone, the delay being estimated according to the estimate of the secondary path transfer function.

In an example, the rate of adaptation is monotonically related to the coherence between the reference signal and the error signal.

In an example, coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

In an example, the error signal comprises the output of a projection filter receiving an input from an error sensor disposed at a position outside the cancellation zone and configured to estimate the residual noise within the cancellation zone.

In an example, the first adaptive algorithm and the second adaptive algorithm are least means squares algorithms.

According to another aspect, a noise-cancellation system with secondary path adaptation includes: a noise-cancellation filter configured to receive a reference signal representative of a source of noise within a predefined volume and generating, based at least in part on the reference signal, a noise-cancellation signal that, when transduced by a speaker, produces a noise-cancellation acoustic signal that reduces noise in a cancellation zone within the predefined volume; a secondary path estimation filter configured to calculate an estimate of secondary path transfer function, the secondary path transfer function being a transfer function between the speaker and a cancellation zone, an secondary path adaptive module configured to adjust coefficients of the secondary path estimation filter according to a second adaptive algorithm, wherein a rate of adaptation of the second adaptive algorithm is based, at least in part, on a coherence between the reference signal and an error signal representative of residual noise within the cancellation zone, and an echo canceler receiving a program content signal, the program content signal being transduced by the speaker into a program content acoustic signal, the echo canceler comprising an echo canceler filter implementing the estimate of the secondary path transfer function such that the echo canceler filter outputs an estimated program content signal that estimates the program content signal acoustic signal at the cancellation zone, the estimated program content signal being subtracted from the error signal to cancel a component of the input attributable to the program content acoustic signal.

In an example, the rate of adaptation is monotonically related to the coherence between the reference signal and the error signal.

In an example, the coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

In an example, the error signal comprises the output of a projection filter receiving an input from an error sensor disposed at a position outside the cancellation zone and configured to estimate the residual noise within the cancellation zone.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Adaptive noise-cancellation systems that cancel noise within a predefined volume (such as within a vehicle cabin) typically employ an estimate of the secondary path transfer function (i.e., the path between the speaker to the cancellation zone). The physical secondary path transfer function, however, can change over time as a result of changing acoustic features of the vehicle (e.g., aging speakers) as well as changes within the predefined volume (such as changing seat positions, introducing a suitcase to the vehicle cabin). If the adaptive noise-cancellation system does not adapt to the change in the secondary transfer function, the performance of the adaptive noise-cancellation system will degrade. Accordingly, there is a need to adapt the estimated secondary path transfer function over time.

Figure 1:
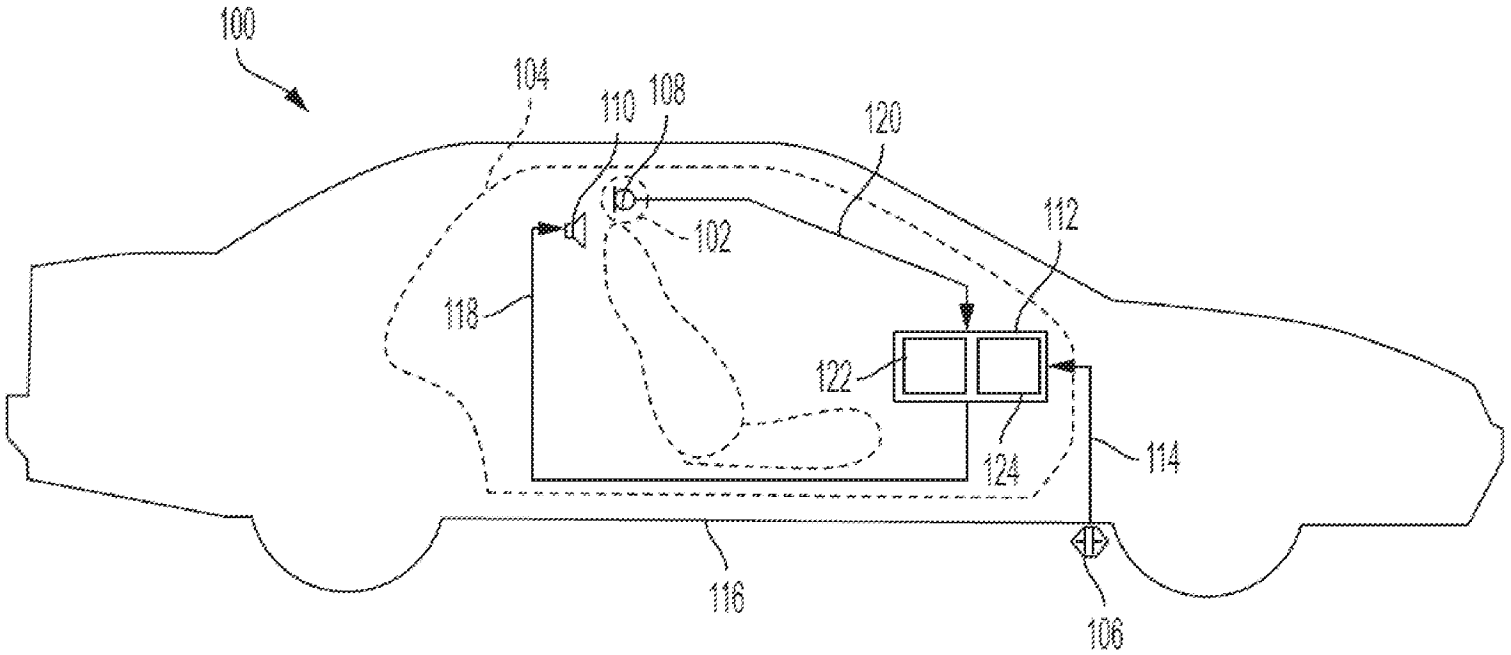
FIG. 1 depicts a schematic of a noise-cancellation system implemented in a vehicle, according to an example.

FIG. 1 is a schematic view of an example noise-cancellation system 100. Noise-cancellation system 100 can be configured to destructively interfere with undesired sound in at least one cancellation zone 102 within a predefined volume 104 such as a vehicle cabin. At a high level, an example of noise-cancellation system 100 can include a reference sensor 106, an error sensor 108, a speaker 110, and a controller 112.

In an example, reference sensor 106 is configured to generate reference signal(s) 114 representative of the undesired sound, or a source of the undesired sound, within predefined volume 104. For example, as shown in FIG. 1, reference sensor 106 can be an accelerometer, or a plurality of accelerometers, mounted to and configured to detect vibrations transmitted through a vehicle structure 116. Vibrations transmitted through the vehicle structure 116 are transduced by the structure into undesired sound in the vehicle cabin (perceived as road noise), thus an accelerometer mounted to the structure provides a signal representative of the undesired sound Speaker 110 can, for example, be speakers distributed in discrete locations about the perimeter of the predefined volume. In an example, four or more speakers can be disposed within a vehicle cabin, each of the four speakers being located within a respective door of the vehicle and configured to project sound into the vehicle cabin. In alternate examples, speakers can be located within a headrest, or elsewhere in the vehicle cabin.

A noise-cancellation signal 118 can be generated by controller 112 and provided to one or more speakers 110 (also referred to as actuators, a speaker is any device configured to receive an electrical signal and transduce it into an acoustic signal) in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise-cancellation within one or more predefined cancellation zones 102 with the predefined volume. The noise-cancellation within the cancellation zones can effect a reduction in undesired sound by approximately 3 dB or more (although in varying examples, different amounts of noise-cancellation can occur). Furthermore, the noise-cancellation can cancel sounds in a range of frequencies, such as frequencies less than approximately 350 Hz (although other ranges are possible).

Error sensor 108, disposed within the predefined volume, generates an error signal 120 based on detection of residual noise resulting from the combination of the sound waves generated from the noise-cancellation signal 118 and the undesired sound in the cancellation zone. The error signal 120 is provided to controller 112 as feedback, error signal 120 representing residual noise uncanceled by the noise-cancellation signal. Error sensors 108 can be, for example, at least one microphone mounted within a vehicle cabin (e.g., in the roof, headrests, pillars, or elsewhere within the cabin).

It should be noted that the cancellation zone(s) can be positioned remotely from error sensor 108. In this case, the error signal 120 can be filtered to represent an estimate of the residual noise in the cancellation zone(s). In either case, the error signal will be understood to represent residual undesired noise in the cancellation zone.

In an example, controller 112 can comprise a non-transitory storage medium 122 and processor 124. In an example, non-transitory storage medium 122 can store program code that, when executed by processor 124, implements the various filters and algorithms described below. Controller 112 can be implemented in hardware and/or software. For example, controller can be implemented by a SHARC floating-point DSP processor, but it should be understood that controller can be implemented by any other processor, FPGA, ASIC, or other suitable hardware.

Figure 2A:
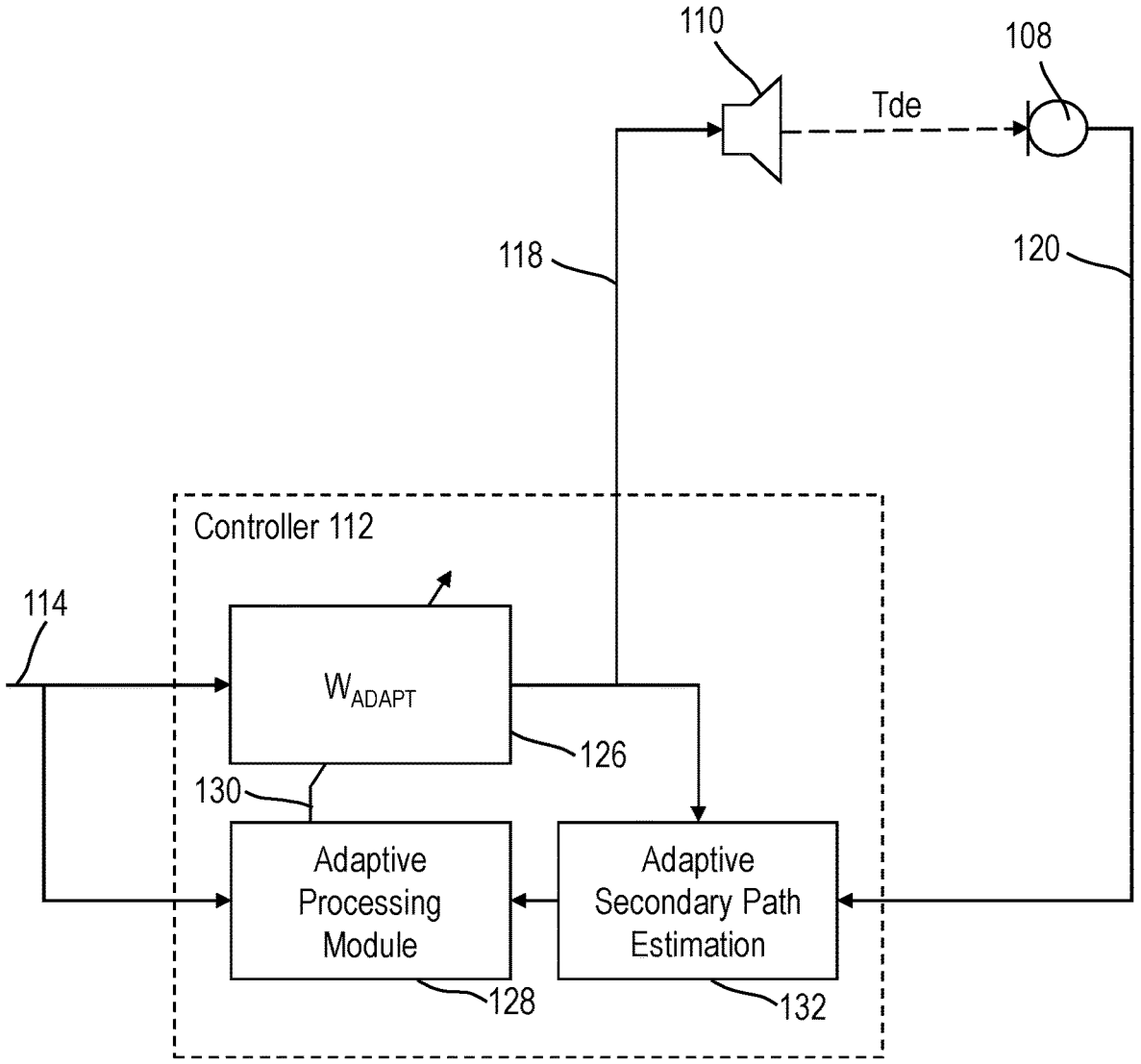
FIG. 2A depicts a block diagram of a noise-cancellation system, according to an example.

Turning to FIG. 2A, there is shown a block diagram of an example of noise-cancellation system 100, including a plurality of filters implemented by controller 112. As shown, controller can define a control system including $W_{adapt}$ filter 126 and an adaptive processing module 128.

$W_{adapt}$ filter 126 is configured to receive the reference signal 114 of reference sensor 106 and to generate noise-cancellation signal 118. Noise-cancellation signal 118, as described above, is input to speaker 110 where it is transduced into the noise-cancellation audio signal that destructively interferes with the undesired sound in the predefined cancellation zone 102. $W_{adapt}$ filter 126 can be implemented as any suitable linear filter, such as a multi-input multi-output (MIMO) finite impulse response (FIR) filter. $W_{adapt}$ filter 126 employs a set of coefficients which define the noise-cancellation signal 118 and which can be adjusted to adapt to changing behavior of the vehicle response to road input (or to other inputs in non-vehicular noise-cancellation contexts).

Adjustments to the coefficients can be performed by an adaptive processing module 128, which receives as inputs the error signal 120 (as acted upon by adaptive secondary path estimation module 132, as will be described below) and the reference signal 114 and, using those inputs, generates a filter update signal 130. The filter update signal 130 is an update to the filter coefficients implemented in $W_{adapt}$ filter 126. The noise-cancellation signal 118 produced by the updated $W_{adapt}$ filter 126 will minimize error signal 120, and, consequently, the undesired noise in the cancellation zone.

The coefficients of $W_{adapt}$ filter 126 at time step n can be updated according to the following equation:

$$W_{adapt}[n+1] = W_{adapt}[n] + \mu_W(\tilde{T}'_{dc} * e)\frac{x}{\|x\|_2} \tag{1}$$

where $\tilde{T}_{dc}$ is an estimate of the physical transfer function $T_{dc}$ between speaker 110 and the noise-cancellation zone 102 (alternately referred to as the secondary path), $\tilde{T}'_{dc}$ is the conjugate transpose of $\tilde{T}_{dc}$, e is the error signal 120, and x is the reference signal 114. In the update equation, the reference signal x is divided by the norm of x, represented as $\|x\|_2$, and $\mu_w$ is the step size (which determines rate of adaptation). In this equation, the convolution of error signal e with the conjugate transpose of $\tilde{T}_{dc}$ results, in effect, in the backing out the delay (i.e., the phase shift) in the time domain caused by the secondary path, thus aligning in time the reference signal x (which has not similarly traveled through the secondary path) and the error signal e. The initial value of the estimate of secondary path transfer function $\tilde{T}_{dc}$ (and, consequently, the value of the conjugate transpose $\tilde{T}'_{dc}$) can be determined a priori, according, for example, to a signal received from test microphone disposed within the vehicle cabin during a tuning phase; however, this value will be adapted during runtime as described below.

In application, the total number of filters is generally equal to the number of reference sensors (M) multiplied by the number of speakers (N). Each reference sensor signal is filtered N times, and each speaker signal is then obtained as a summation of M signals (each sensor signal filtered by the corresponding filter).

As mentioned above, over time, the secondary path transfer function $T_{dc}$ can change as a result of changes to the acoustic features of and composition of the cabin. Accordingly, it is necessary to adapt the estimate of the secondary path transfer function $\tilde{T}_{dc}$, and thus the estimate of conjugate transpose $\tilde{T}'_{dc}$ to account for changes in the physical secondary path transfer function. This is accomplished in FIG. 2A by adaptive secondary path estimation module 132, which calculates the estimated secondary path transfer function $\tilde{T}_{dc}$ in an adaptive manner. In this example, adaptive secondary path estimation module 132 receives error signal 120 and outputs an estimated error signal $\tilde{e}$, in which the phase shift of the estimated secondary path transfer function $\tilde{T}_{dc}$ is removed. Stated in terms of Eq. (1) adaptive secondary path estimation module 132 receives the error signal e and outputs $\tilde{T}'_{dc}$*e, which, in the time domain, removes the phase shift of $\tilde{T}_{dc}$ from error signal e.

Figure 3A:
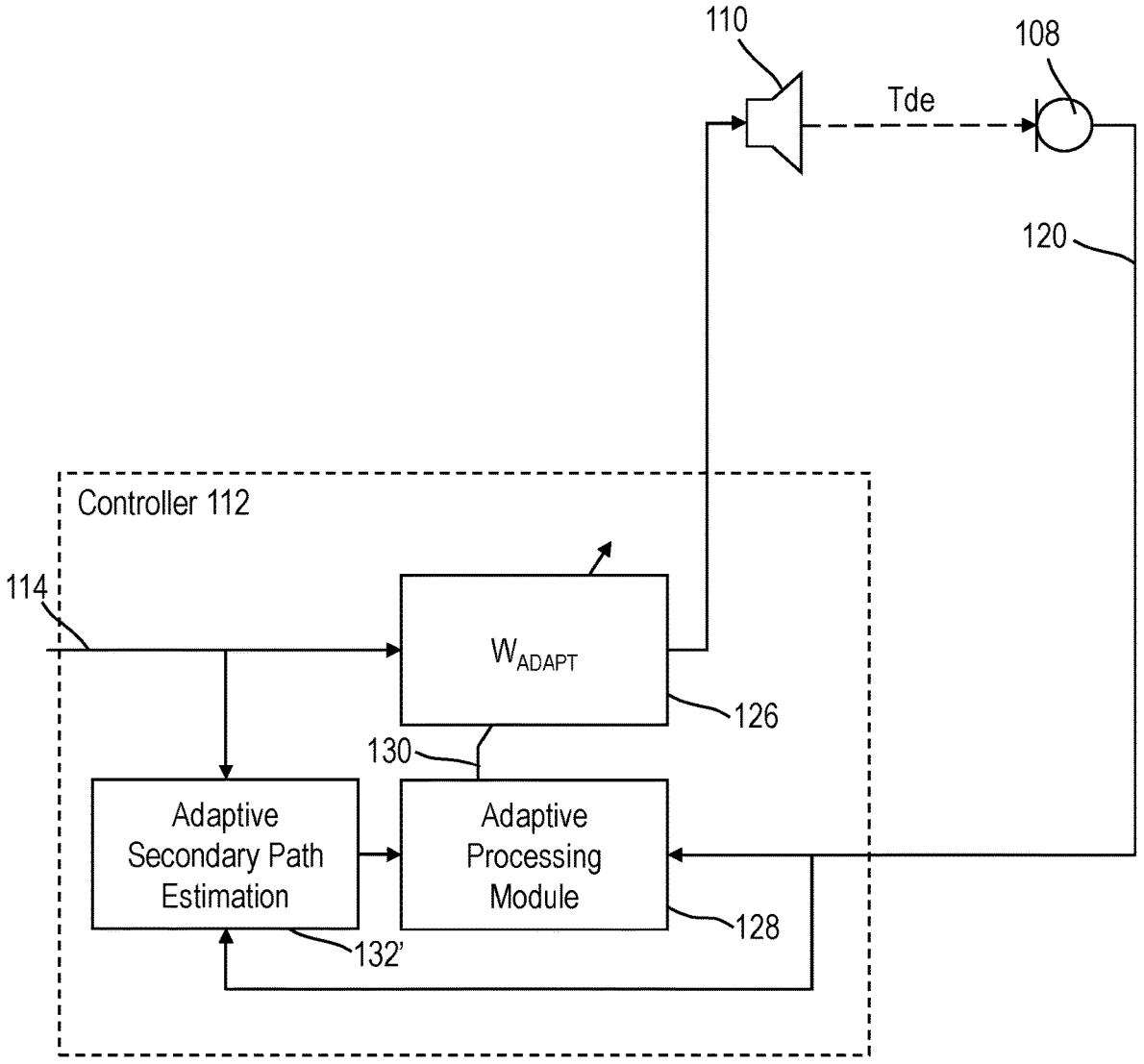
FIG. 3A depicts a block diagram of a noise-cancellation system, according to an example.

FIG. 3A depicts an alternative example of noise-cancellation system 100. In this example, noise-cancellation system 100 employs a filtered-x algorithm that, instead of removing an estimate of the phase-shift induced by secondary path transfer function $T_{dc}$ from error signal e, the estimate of the phase shift of the secondary path transfer function $T_{dc}$ is added to the reference signal x, as follows:

$$W_{adapt}[n+1] = W_{adapt}[n] * \mu_W * e\frac{(\tilde{T}_{dc} * x)}{\|x\|_2} \tag{2}$$

Thus, in this example, adaptive secondary path estimation module 132 calculates the secondary path transfer function $\tilde{T}_{dc}$ and adds the delay (phase shift) of this function to the reference signal x to output an estimated reference signal $\tilde{x}$ (which, in effect, equals $\tilde{T}_{dc}$*x), in order to time-align reference signal x with error signal e.

Figure 2B:
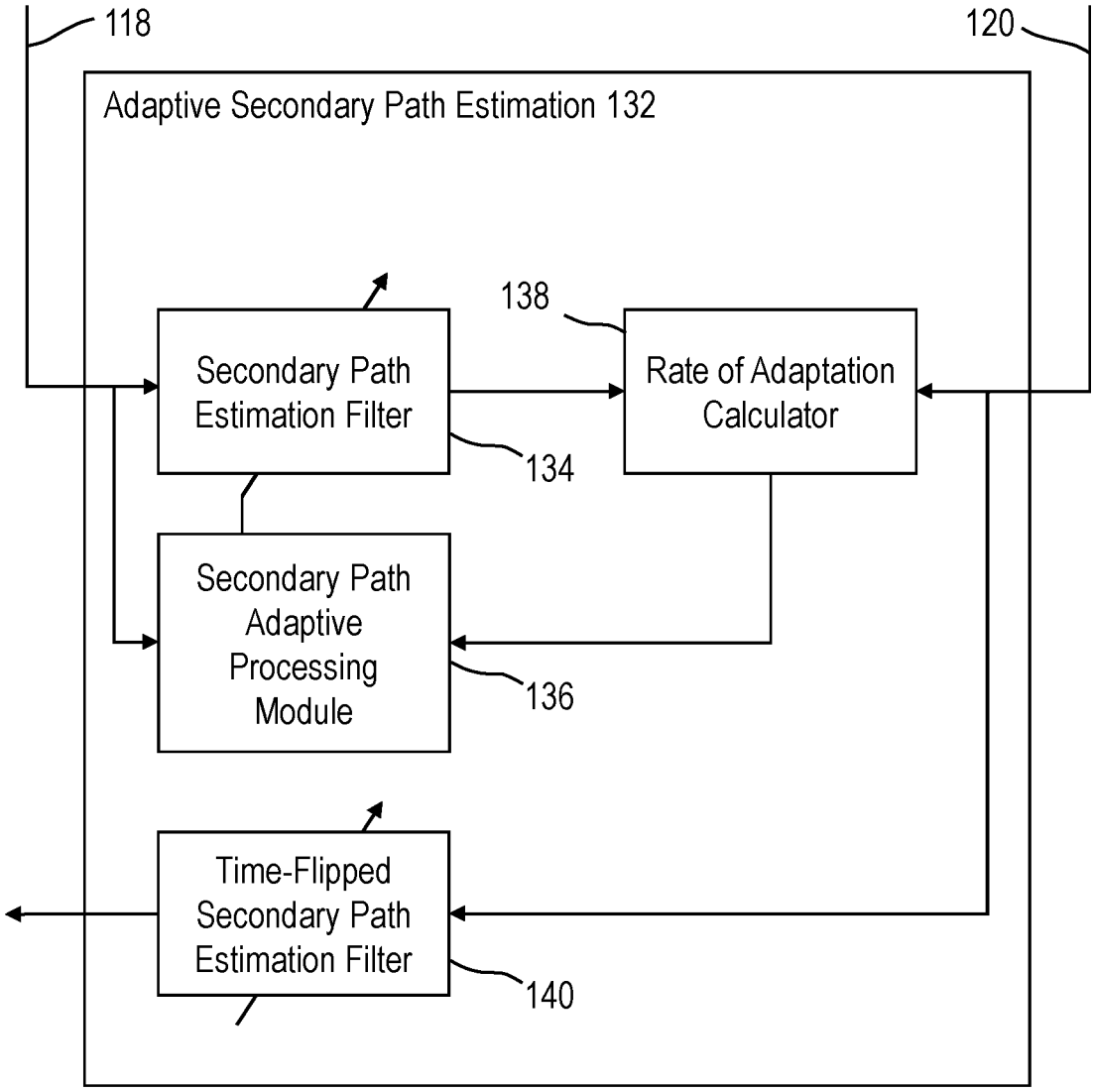
FIG. 2B depicts a block diagram of an adaptive secondary path estimation module, according to an example.

FIG. 2B depicts an example secondary path transfer module 132. In this example, adaptive secondary path estimation module 132 comprises secondary path estimation filter 134 and secondary path adaptive processing module 136. Secondary path estimation filter 134 implements the estimated secondary path $\tilde{T}_{dc}$ transfer function, thus acting on the input signal to produce an output that represents an estimate of the input signal having traveled through the secondary path $T_{dc}$.

Secondary path adaptive processing module 136 adjusts the coefficients of secondary path estimation filter 134 to minimize error signal 120 according to the following update equation:

$$\tilde{T}_{dc}[n+1] = \tilde{T}_{dc}[n] + (\mu_{Tdc} * e)W_{adapt}\frac{x}{\|x\|_2} \tag{3}$$

which may be rewritten as $$\tilde{T}_{dc}[n+1]=\tilde{T}_{dc}[n](\mu_{Tdc}*e)d \tag{4}$$

where d is the noise-cancellation signal 118 output by $W_{adapt}$ filter 126.

The update Eqs. (1) and (4) operate together to minimize error signal e. However, in an n-variable problem, the set of correct step directions only points to the right set of quadrants to move, the not exact directions, which are instead determined by the step sizes. The step size $\mu_{Tdc}$ of Eq. (4) is determined, in the example of FIG. 2A, by rate of adaptation calculator 138 according to the coherence between the noise-cancellation signal d (alternately referred to as noise-cancellation signal 118) at the cancellation zone (denoted as y) and the error signal e as follows:

$$C_{ye}(f) = \frac{|S_{ye}(f)|^2}{S_{yy}(f)S_{ee}(f)} \tag{5}$$

To perform this calculation, rate of adaptation calculator 138 receives as inputs error signal e and noise-cancellation signal at the cancellation zone y from the output of secondary path estimation filter 134. Secondary path estimation filter 134 itself receives the noise-cancellation signal d and thus outputs noise-cancellation signal at the cancellation zone y.

Generally speaking, if the adaptive algorithms of adaptive processing module 128 and secondary path adaptive processing module 136 have converged, the coherence between the error signal e and the noise-cancellation signal at the cancellation zone y should be zero or near to it; whereas, if the adaptive algorithms have not converged, the coherence between the error signal e and the noise-cancellation signal at the cancellation zone y will grow to some value toward one (which represents total coherence between error e and the noise-cancellation signal at the cancellation zone y). In an example, step size $\mu_{Tdc}$, in the frequency domain, is proportional to the coherence $C_{ye}$, as follows:

$$\mu_{Tdc}(f)=\mu_0 C_{ye} \tag{6}$$

where $\mu_0$ is a constant of proportionality to relating the coherence $C_{ye}$ to the step size $\mu_{Tdc}$. Eq. (6) occurs in the frequency domain because coherence is determined across frequency. This thus requires that the calculation of each update occur in the frequency domain and be multiplied, per frequency bin, by the frequency domain value of $\mu_{Tde}(f)$, before being converted back to the time domain.

It should be understood that the value of the step size $\mu_{Tdc}$ need not be directly proportional to coherence $C_{ye}$. Rather, the value of the step size can be monotonically related to the coherence $C_{ye}$—that is, the coherence $\mu_{Tdc}$ dictates, generally, the size of the step size according to whether it grows or diminishes. Thus, in an example, the frequency domain step size $\mu_{Tdc}$ can be determined by the following equation:

$$\mu_{Tdc}(f) = \begin{cases} \mu_0 * (C_{ye}(f)+C_{ye,avg}), & [40, 450\text{ Hz}] \\ \mu_0 * (C_{ye,avg}), & \text{otherwise} \end{cases} \tag{7}$$

where in the example frequency range of interest [40, 450 Hz] the frequency domain step size $\mu_{Tdc}$ is proportional to the sum of coherence $C_{ye}$ and the average coherence across frequency $C_{ye,avg}$. Summing coherence $C_{ye}$ with the average coherence $C_{ye,avg}$ helps to eliminate ringing effects that are often otherwise present.

Because $W_{adapt}$ filter 126 and physical transfer function $T_{dc}$ are both linear processes, the coherence $C_{ye}$ between noise-cancellation signal at the cancellation zone y and the estimated error signal e is the same as the coherence or multi-coherence $C_{de}$ between the noise-cancellation signal(s) d error signal e and the same as the coherence or multi-coherence $C_{xe}$ between the reference signal(s) x and the error signal e. Accordingly, the coherence $C_{ye}$ can be conceived of as a way of calculating a value of the coherences $C_{de}$ and $C_{xe}$. Generally, calculating $C_{ye}$ is preferable to calculating $C_{de}$ or $C_{xe}$ as a matter of practicality since there are typically some number N reference signals x and some number M of noise-cancellation signals d. Calculation of $C_{de}$ or $C_{xe}$ would require computation of an inverse PSD matrix that is the same rank as the number of inputs (i.e., reference signals or noise-cancellation signals). Such a computation is processing intensive and difficult to perform in real-time applications. By contrast, there is only a single computed noise-cancellation signal at the cancellation zone y, so calculating coherence $C_{ye}$ does not require a multi-coherence, rather requiring only requiring the computation of noise-cancellation signal at the cancellation zone y, e.g., the computation of $\tilde{T}_{dc}$*d by secondary path estimation filter 134, which entails convolution or matrix multiplication that is computationally much faster than matrix inversion.

The calculation of step size $\mu_{Tdc}$ assumes that $W_{adapt}$ has converged to its optimal solution and so is effectively constant. This is a reasonable assumption, since the step size $\mu_W$ is generally much faster than step size $\mu_{Tdc}$. Thus, any non-zero coherence value $C_{ye}$ (or $C_{de}$ or $C_{xe}$) attributable to $W_{adapt}$ filter 126 not yet converging will likely be resolved (i.e. $W_{adapt}$ filter 126 will have converged) before the estimated secondary path estimation filter 134 is adapted. Stated differently, any residual coherence $C_{ye}$ following the rapid convergence of $W_{adapt}$ filter 126 is attributable to the estimated secondary path estimation filter 134 incorrectly estimating secondary path $T_{de}$ and thus can be relied upon for adjusting step size $\mu_{Tdc}$.

In an alternative example, rather than relying on the coherence $C_{ye}$, the magnitude of the error signal e can determine the size of the step size $\mu_{Tdc}$. For example, rate of adaptation calculator 138 can set the step size $\mu_{Tdc}$ to be proportional or otherwise monotonically related to the magnitude of the error signal e. However, the coherence $C_{ye}$ is generally more desirable since it is always positive and bounded.

Once the estimated secondary path $\tilde{T}_{dc}$ is adjusted according Eq. (4) using the step size $\mu_{Tdc}$ determined from the rate of adaptation calculator 138, the result is time-flipped to yield the time-flipped secondary path estimation filter 140. Time-flipped secondary path estimation filter 140 thus applies the time-flipped estimation of the secondary path transfer function $\tilde{T}_{de}$ to the input error signal e. (Because the output of the time-flipped secondary path estimation filter 140 is based on the estimate of the secondary path transfer function $\tilde{T}_{de}$, time-flipped secondary path estimation filter 140 can be considered a version of secondary path estimation filter 134.) The output of time-flipped secondary path estimation filter 140 is an estimated error signal e with the delay (phase shift) of the estimated secondary path transfer function $\tilde{T}_{de}$ removed.

Figure 3B:
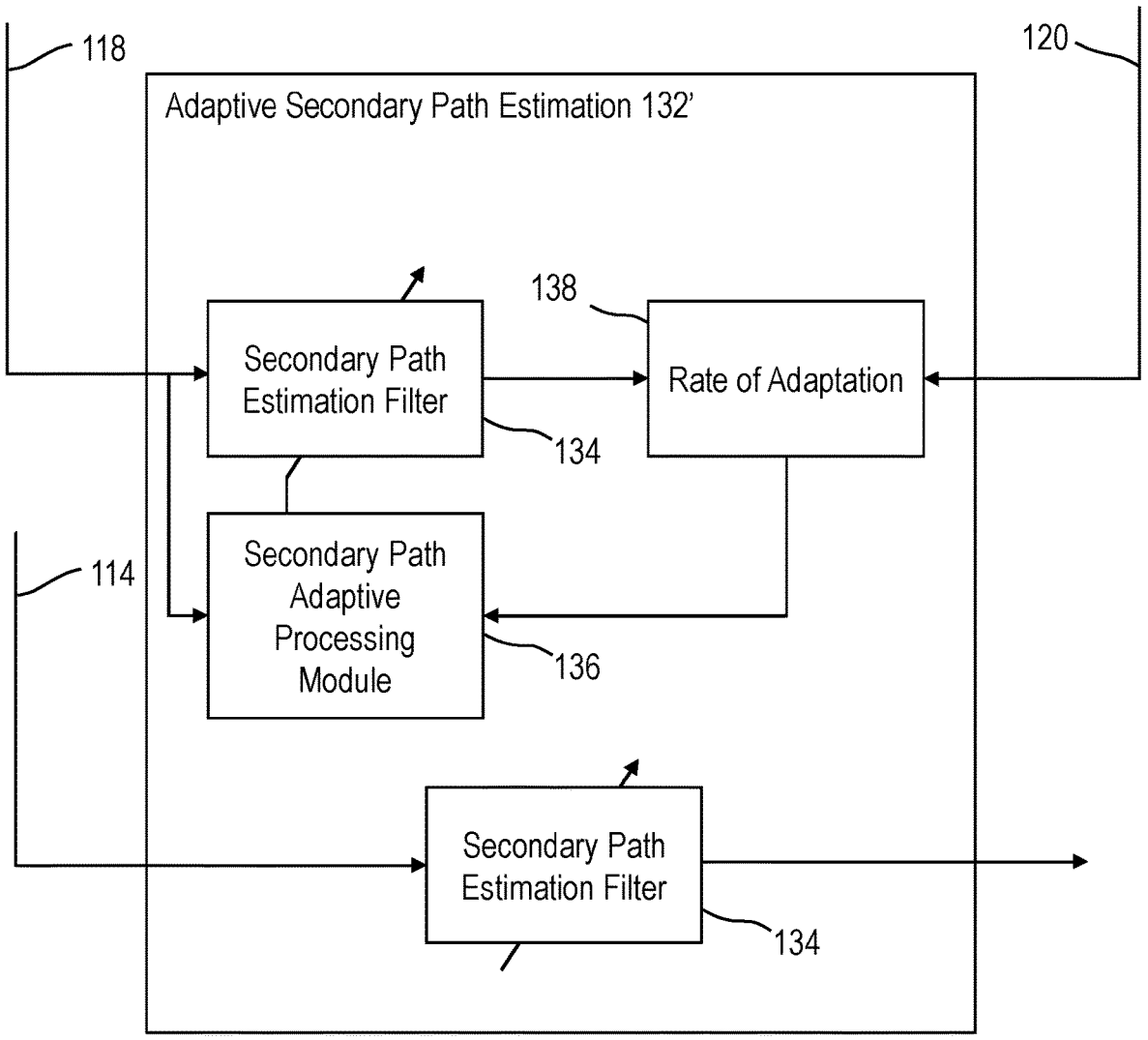
FIG. 3B depicts a block diagram of an adaptive secondary path estimation module, according to an example.

Turning briefly to FIG. 3B, the process is the same, except the reference signal x is received at secondary path estimation filter 134, the output of which the reference signal x with the phase shift of the estimated secondary transfer function $\tilde{T}_{de}$ added. In this manner, both adaptive secondary path estimation module 132 and 132' calculate an estimated secondary path transfer function and $\tilde{T}_{dc}$ and generate an output signal (either the estimated error signal $\tilde{e}$ or the estimated reference signal $\tilde{x}$) that is based, at least, on the input signal (error signal e or reference signal x) and the estimate of the secondary path transfer function $\tilde{T}_{de}$.

Figure 4:
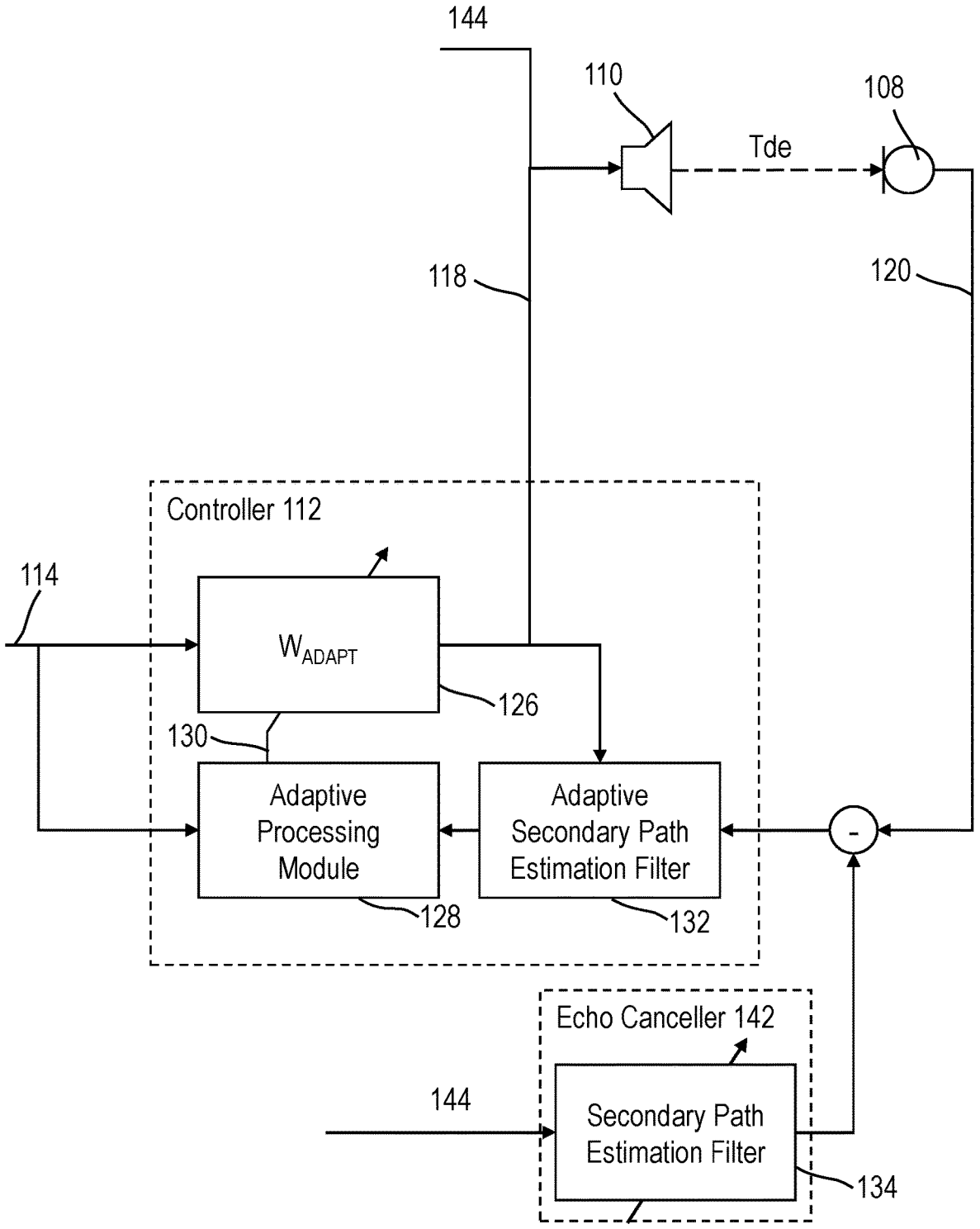
FIG. 4 depicts a block diagram of a noise-cancellation system with an echo canceller, according to an example.

Turning to FIG. 4, there is shown an example of echo canceller 142 using the secondary path estimation filter 134. More particularly echo canceller 142 inputs program content signal 144 (e.g., music, navigation, etc.), that is transduced by speaker 110 into an acoustic signal, to secondary path estimation filter 134 to output a estimation of the program content signal at the cancellation zone, which is, in turn, subtracted from error signal 120 in order to cancel echo attributable to the transduction of program content signal 144. As secondary path estimation filter 134 is updated by secondary path adaptive processing module 136, it will too adapt to changing physical transfer function $T_{dc}$.

Again, the noise-cancellation system 100 of FIGS. 1-4 is merely provided as an example of such a system. This system, variants of this system, and other suitable noise-cancellation systems can be used within the scope of this disclosure. For example, while the system of FIGS. 1-2 has been described in conjunction with a least-means-squares filter (LMS/NLMS), in other examples a different type of filter, such as one implemented with a recursive-lease-squares (RLS) filter can be implemented. Likewise, while a noise-cancellation system with feedback has been described, in alternative examples, such a system can employ a feed-forward topology. Furthermore, while a vehicle-implemented noise-cancellation system for cancelling road noise has been described, any suitable noise-cancellation system with some need for secondary path adaptation can be used.

Figure 5:
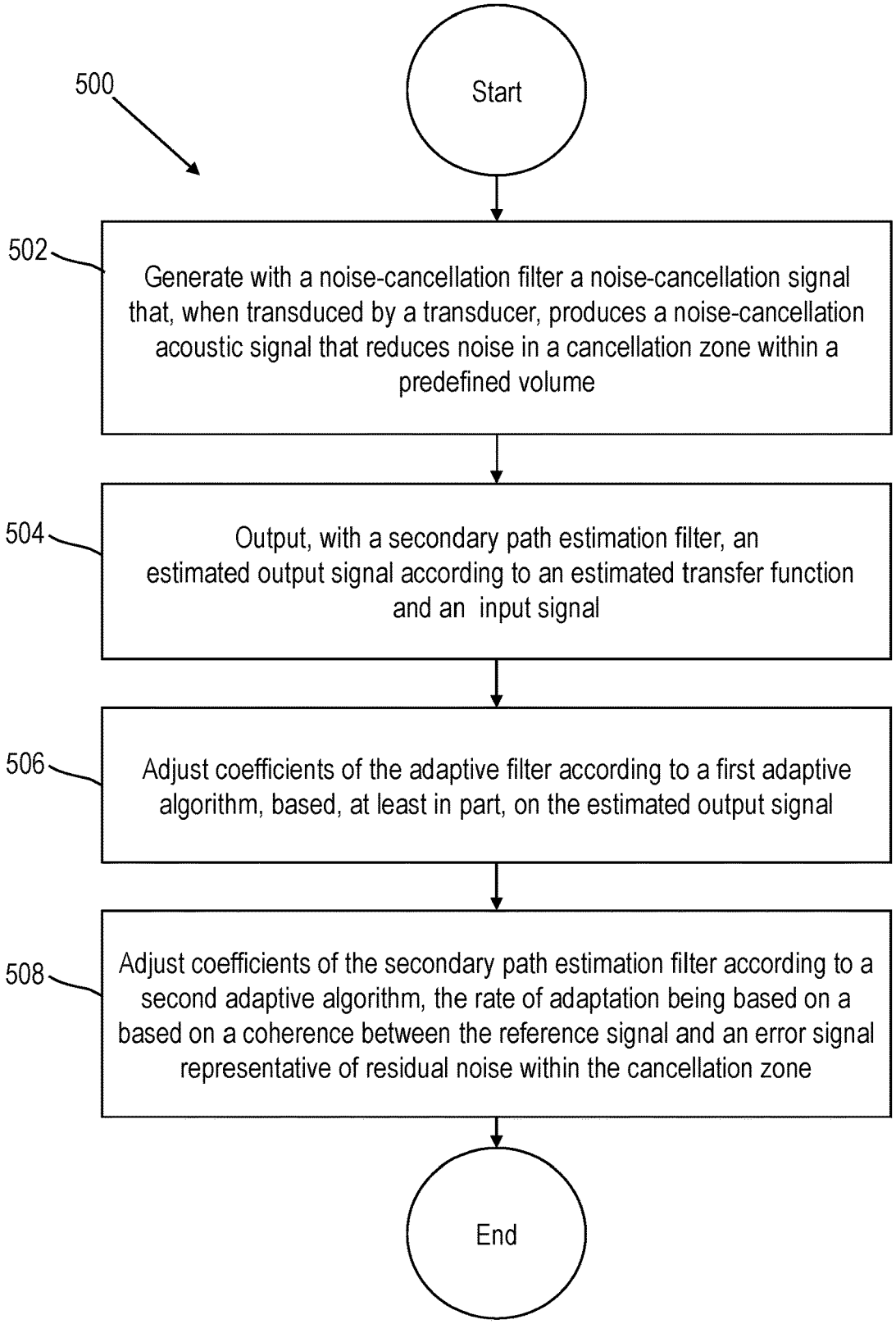
FIG. 5 depicts of method of cancellation noise with secondary path estimation adaptation, according to an example.

FIG. 5 depicts a flowchart of a method 500 for estimating a secondary path transfer function and adapting a noise-cancellation system accordingly. As described above, this method can be implemented by a computing device, such as controller 112. Generally, the steps of the computer-implemented method are stored in a non-transitory storage medium and are executed by the processor of the computing device. However, at least some of the steps can be carried out in hardware rather than by software.

At step 502 a noise-cancellation signal is generated by a noise-cancellation filter, which, when transduced by a speaker, produces a noise-cancellation acoustic signal that reduces noise in a cancellation zone within a predefined volume. An example of such a noise-cancellation filter can be $W_{adapt}$ filter 126, although other suitable adaptive filters, such as RLS filters can be used. The signal is provided to at least one speaker to produce the noise-cancellation acoustic signal in the predefined volume.

At step 504, an estimated output signal is output from a secondary path estimation filter (e.g., secondary path estimation filter 134 or time-flipped secondary path estimation filter 140) according to an input signal (e.g., error signal 120 or reference signal 114) and the estimate of the secondary path transfer function implemented by secondary path estimation filter. Stated differently, the secondary path estimation filter receives the input signal and acts on that input signal to output an estimated output signal that is an estimate of the input signal with a phase shift according to the estimated secondary path.

It should be understood that the error signal can be an output of an error sensor, such as a microphone disposed within the cancellation zone. Alternatively, the error signal can be a filtered output of a microphone disposed outside the cancellation zone, which estimates the error signal within the cancellation zone. Such as a filtered error signal is described, for example, in U.S. Pat. No. 10,629,183 titled "Systems and methods for noise-cancellation using microphone projection," the entirety of which is incorporated herein by reference.

The error signal may also have removed an echo from a speaker playing a program content signal (e.g., music, navigation, etc.). The echo can be determined by inputting the program content signal to the secondary path estimation filter to determine an estimated program content representative of the program content signal in the cancellation zone. This estimated program content signal can be removed from the error signal (e.g., the output of the microphone or the filtered output).

At step 506, the coefficients of the adaptive filter are updated based on, e.g., Eq. (1) or (2), and the estimated output signal determined in step 504. The estimated output signal can be, in the filtered error example (e.g., as shown in FIG. 2B), the error signal with the phase shift of the estimated secondary path removed (where the secondary path estimation filter is time-flipped). Alternatively, the estimated output signal can be, in the filtered-reference example (e.g., as shown in FIG. 3B), the reference with the phase shift of the estimated secondary path added. In an alternative example, the coefficients of the adaptive filter can be updated using a different update equation (e.g., RLS).

At step 508, the coefficients of the secondary path estimation filter are updated, using, e.g., Eq. (4). The rate of adaptation, e.g., the step size, can be determined according to a coherence between the error signal and an estimation of the noise-cancellation signal in the cancellation zone. The estimation of the noise-cancellation signal in the cancellation zone can be determined, for example, by inputting the noise-cancellation signal the secondary path estimation filter. Alternatively, the rate of adaptation can be determined according to a coherence between the error signal and the noise-cancellation signal or between the error signal and the reference signal. In one example, the rate of adaptation of is proportional to, or otherwise monotonically related to, the coherence between the error signal and the noise-cancellation signal in the cancellation zone (or the noise-cancellation signal or the reference signal). In an alternative example, the rate of adaptation can be determined according to the magnitude of the error signal, rather than according to a coherence between the error signal and another signal.

Regarding the use of symbols herein, a capital letter, e.g., H, generally represents a term, signal, or quantity in the frequency or spectral domain, and a lowercase letter, e.g., h, generally represents a term, signal, or quantity in the time domain. Relation between time and frequency domain is generally well known, and is described at least under the realm of Fourier mathematics or analysis, and is accordingly not presented herein. Additionally, signals, transfer functions, or other terms or quantities represented by symbols herein may be operated, considered, or analyzed in analog or discrete form. In the case of time domain terms or quantities, the analog time index, e.g., t, and/or discrete sample index, e.g., n, may be interchanged or omitted in various cases. Likewise, in the frequency domain, analog frequency indexes, e.g, f, and discrete frequency indexes, e.g., k, are omitted in most cases. Further, relationships and calculations disclosed herein may generally exist or be carried out in either time or frequency domains, and either analog or discrete domains, as will be understood by one of skill in the art. Accordingly, various examples to illustrate every possible variation in time or frequency domains, and analog or discrete domains, are not presented herein.

The functionality described herein, or portions thereof, and its various modifications (hereinafter "the functions") can be implemented, at least in part, via computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A noise-cancellation system with secondary path adaptation, comprising:

a noise-cancellation filter configured to receive a reference signal representative of a source of noise within a predefined volume and generating, based at least in part on the reference signal, a noise-cancellation signal that, when transduced by a speaker, produces a noise-cancellation acoustic signal that reduces noise in a cancellation zone within the predefined volume;

a secondary path estimation filter configured to receive an input signal and to implement an estimate of secondary path transfer function, the secondary path transfer function being a transfer function between the speaker and a cancellation zone, the secondary path estimation filter outputting an output signal based, at least in part, on the estimate of the secondary path transfer function and the input signal;

an adaptive module configured to adjust coefficients of the noise-cancellation filter according to a first adaptive algorithm, based, at least in part, on the estimated output signal; and an secondary path adaptive module configured to adjust coefficients of the secondary path estimation filter according to a second adaptive algorithm, wherein a rate of adaptation of the second adaptive algorithm is based, at least in part, on a coherence between the reference signal and an error signal representative of residual noise within the cancellation zone.

2. The noise-cancellation system of claim 1, wherein the input signal is the error signal, wherein the output signal is an estimated error that is phase-shifted with respect to the error signal to remove a delay between the speaker and the cancellation zone, wherein the delay is determined according to the estimate of the secondary path transfer function.

3. The noise-cancellation system of claim 1, wherein the input signal is the reference signal, wherein the output signal is an estimated reference signal that is phase-shifted with respect to the error signal to introduce a delay between the speaker and the cancellation zone, the delay being estimated according to the estimate of the secondary path transfer function.

4. The noise-cancellation system of claim 1, wherein the rate of adaptation is monotonically related to the coherence between the reference signal and the error signal.

5. The noise-cancellation system of claim 1, wherein the coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

6. The noise-cancellation system of claim 1, wherein the error signal comprises the output of a projection filter receiving an input from an error sensor disposed at a position outside the cancellation zone and configured to estimate the residual noise within the cancellation zone.

7. The noise-cancellation system of claim 1, wherein the first adaptive algorithm and the second adaptive algorithm are each least mean squares algorithms.

8. The noise-cancellation system of claim 1, wherein the error signal comprises the output of an echo canceler receiving an input from an error sensor and cancelling a component of the input attributable to the output of the speaker or at least a second speaker in the predefined volume.

9. The noise-cancellation system of claim 1, further comprising an echo canceler receiving a program content signal, the program content signal being transduced by the speaker into a program content acoustic signal, the echo canceler comprising an echo canceler filter implementing the estimate of the secondary path transfer function such that the echo canceler filter outputs an estimated program content signal that estimates the program content signal acoustic signal at the cancellation zone, the estimated program content signal being subtracted from an input received from an error sensor to cancel a component of the input attributable to the program content acoustic signal.

10. A non-transitory storage medium comprising program code that, when executed by a processor, implements the steps of:

receiving a reference signal representative of a source of noise within a predefined volume and generating with a noise-cancellation filter, based at least in part on the reference signal, a noise-cancellation signal that, when transduced by a speaker, produces a noise-cancellation acoustic signal that reduces noise in a cancellation zone within the predefined volume;

outputting, with a secondary path estimation filter, an estimated output according to an estimate of a secondary path transfer function, the secondary path transfer function being a transfer function between the speaker and a cancellation zone, and an input signal;

adjusting coefficients of the noise-cancellation filter according to a first adaptive algorithm, based, at least in part, on the estimated output signal; and adjusting coefficients of the secondary path estimation filter according to a second adaptive algorithm, wherein a rate of adaptation of the second adaptive algorithm is based, at least in part, on a coherence between the reference signal and an error signal representative of residual noise within the cancellation zone.

11. The non-transitory storage medium of claim 10, wherein the input signal is the error signal, wherein the output signal is an estimated error that is phase-shifted with respect to the error signal to remove a delay between the speaker and the cancellation zone, wherein the delay is determined according to the estimate of the secondary path transfer function.

12. The non-transitory storage medium of claim 10, wherein the input signal is the reference signal, wherein the output signal is an estimated reference signal that is phase-shifted with respect to the error signal to introduce a delay between the speaker and the cancellation zone, the delay being estimated according to the estimate of the secondary path transfer function.

13. The non-transitory storage medium of claim 10, the rate of adaptation is monotonically related to the coherence between the reference signal and the error signal.

14. The non-transitory storage medium of claim 10, wherein the coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

15. The non-transitory storage medium of claim 10, wherein the error signal comprises the output of a projection filter receiving an input from an error sensor disposed at a position outside the cancellation zone and configured to estimate the residual noise within the cancellation zone.

16. The non-transitory storage medium of claim 10, wherein the first adaptive algorithm and the second adaptive algorithm are least means squares algorithms.

17. A noise-cancellation system with secondary path adaptation, comprising:

a noise-cancellation filter configured to receive a reference signal representative of a source of noise within a predefined volume and generating, based at least in part on the reference signal, a noise-cancellation signal that, when transduced by a speaker, produces a noise-cancellation acoustic signal that reduces noise in a cancellation zone within the predefined volume;

a secondary path estimation filter configured to calculate an estimate of secondary path transfer function, the secondary path transfer function being a transfer function between the speaker and a cancellation zone, an secondary path adaptive module configured to adjust coefficients of the secondary path estimation filter according to a second adaptive algorithm, wherein a rate of adaptation of the second adaptive algorithm is based, at least in part, on a coherence between the reference signal and an error signal representative of residual noise within the cancellation zone, and an echo canceler receiving a program content signal, the program content signal being transduced by the speaker into a program content acoustic signal, the echo canceler comprising an echo canceler filter implementing the estimate of the secondary path transfer function such that the echo canceler filter outputs an estimated program content signal that estimates the program content signal acoustic signal at the cancellation zone, the estimated program content signal being subtracted from the error signal to cancel a component of the input attributable to the program content acoustic signal.

18. The noise-cancellation system of claim 17, wherein the rate of adaptation is monotonically related to the coherence between the reference signal and the error signal.

19. The noise-cancellation system of claim 17, wherein the coherence between the reference signal and the error signal is determined by a coherence between the noise-cancellation signal and the error signal or by a coherence between the error signal and an estimate of the noise-cancellation signal at the cancellation zone, the estimate of the noise-cancellation signal at the cancellation zone being determined according to the estimate of the secondary path transfer function.

20. The noise-cancellation system of claim 17, wherein the error signal comprises the output of a projection filter receiving an input from an error sensor disposed at a position outside the cancellation zone and configured to estimate the residual noise within the cancellation zone.

* * * * *